US010508426B2

(12) United States Patent
Xu et al.

(10) Patent No.: US 10,508,426 B2
(45) Date of Patent: Dec. 17, 2019

(54) SELF-ADJUSTABLE GAS ISOLATOR

(71) Applicants: Guangrong Xu, Chengdu (CN); Bin Mao, Chengdu (CN); Jialu Xu, Chengdu (CN)

(72) Inventors: Guangrong Xu, Chengdu (CN); Bin Mao, Chengdu (CN); Jialu Xu, Chengdu (CN)

( * ) Notice: Subject to any disclaimer, the term of this patent is extended or adjusted under 35 U.S.C. 154(b) by 146 days.

(21) Appl. No.: 15/828,486

(22) Filed: Dec. 1, 2017

(65) Prior Publication Data

US 2018/0087249 A1 Mar. 29, 2018

Related U.S. Application Data

(63) Continuation of application No. PCT/CN2015/096750, filed on Dec. 9, 2015.

(30) Foreign Application Priority Data

Jun. 3, 2015 (CN) ..... 2015 1 0296393
Jun. 28, 2015 (CN) ..... 2015 1 0361278
Jul. 15, 2015 (CN) ..... 2015 1 0412042

(51) Int. Cl.

*E03C 1/298* (2006.01)
*E03F 5/04* (2006.01)
*E03C 1/28* (2006.01)
*E03C 1/23* (2006.01)

(52) U.S. Cl.

CPC ..... *E03C 1/298* (2013.01); *E03C 1/23* (2013.01); *E03C 1/281* (2013.01); *E03F 5/0405* (2013.01); *E03F 5/04* (2013.01)

(58) Field of Classification Search

CPC .. E03C 1/298; E03C 1/23; E03C 1/281; E03F 5/0405; E03F 5/04

See application file for complete search history.

(56) References Cited

FOREIGN PATENT DOCUMENTS

CN 2396111 Y * 9/2000 ..... E03C 1/298

OTHER PUBLICATIONS

English Translation of CN-2396111-Y (Year: 2000).*

* cited by examiner

*Primary Examiner* — P. Macade Nichols
(74) *Attorney, Agent, or Firm* — Wayne & Ken, LLC; Tony Hom

(57) ABSTRACT

The present invention discloses a self-adjustable gas isolator, including a floater, a liquid storage device, a liquid outlet, a cover plate, a liquid discharging hole and a pressure balancing device. The floater has a pressure relief port; the pressure balancing device is connected with the floater in fixed position; the floater is sleeved in the liquid storage device and the floater goes up and down along with liquid level in the liquid storage device. The sealing device regulates the opening degree between the floater and the liquid outlet automatically according to the liquid volume discharged, and the pressure balancing device releases gas pressure preventing liquid from discharging, and the discharging speed of liquid is fast. The self-adjustable gas isolator is simple in structure, no components for hooking sundries in its channel, and is not easy to jam. When discharging liquid, the floater swings or rotates with self-cleaning function.

16 Claims, 11 Drawing Sheets

SELF-ADJUSTABLE GAS ISOLATOR

TECHNICAL FIELD

The present invention relates to a sealing device, and more specifically to a self-adjustable gas isolator.

BACKGROUND OF THE PRESENT INVENTION

Some of the existing gas isolators adopt liquid to isolate harmful gas with a fixed type (such as drainage water trap, floor drain and the like), and the sealing function is often lost due to the fact that no liquid is blocked after the liquid is evaporated. This gas isolator also has the defects of bulky, limited installation location and the like. Some of the existing gas isolators adopt spring, magnetic force or gravity principle, and the gas isolator exists the problem of overcoming reaction force of spring, magnetic or gravitational to allow liquid flow, greatly reducing the discharge speed of the liquid. In addition, there is a problem that the complex structure and components for blocking discharging liquid and hooking sundries exist in the liquid discharging channel, it not only further blocks the liquid flowing, but also easily causes the blockage of the channel, besides, it has high maintenance cost, short service life and other defects.

Also, there is a type of gas isolator that utilizes the buoyancy force of water to lift a floater of bowl, sphere, or other shape along with the liquid, realizing the discharge of the liquid and the isolation of the gas. Under an actual working condition, the isolator with this structural form is affected by the pressure generated in the liquid discharging channel, so that the liquid discharging function cannot be well realized.

The technical problem is as follows:

Due to the fact that most of the connected discharging channels are a closed space, in practical application, when the amount of liquid flowing into or out of the channel changes, the above-mentioned gas isolator generate larger positive or negative pressure in the channel, and the positive pressure is opposite to the flowing direction of the liquid to be discharged, so that the liquid discharging speed is greatly reduced, and the negative pressure is used for sucking the floater on the sealing opening to block the liquid discharging channel.

SUMMARY OF THE PRESENT INVENTION

The present invention provides a self-adjustable gas isolator with pressure balance device, comprising a floater, a liquid storage device, a liquid outlet, a cover plate and a liquid discharging hole, wherein the self-adjustable gas isolator further comprises a pressure balancing device; a pressure relief port is provided on the floater, and the pressure balancing device is connected with the floater in fixed position.

The self-adjustable gas isolator automatically eliminates the positive and negative pressure that affects the liquid discharging speed and blocks the liquid discharging channel, and the sizes of the floaters and the liquid discharge port are automatically adjusted according to the volume of the liquid discharged. Hooking sundries and components for blocking discharging liquid are not arranged in the channel. The present invention has the advantages of high liquid discharging speed, being difficult to be blocked and harmful gas isolation with or without liquid; the liquid drives the floater to rotate or swing, so that it has a self-cleaning function, greatly improving the performance of the sealing device, and it has advantages of low use, maintenance cost, long service life and the like.

The technical scheme adopted by the present invention for solving the technical problem is as follows:

As the first preferred scheme of the present invention, the self-adjustable gas isolator comprises a floater, a liquid storage device, a liquid outlet, a cover plate and a liquid discharging hole; the self-adjusting gas isolator further comprises a pressure balancing device; the floater is provided with a pressure relief port, and the pressure balancing device is connected with the floater in fixed position. A groove is arranged on the floater, and a pressure relief port is arranged on the groove; the pressure balancing device comprises a first sealing element and a fourth sealing element, the cover plate is provided with a liquid discharging hole, and the cover plate or the floater is provided with a convex block; one end of the first sealing element is arranged on the groove, and the other end of the first sealing element is in sealing contact connection with the pressure relief port; one end of the fourth sealing element is arranged on the top of the floater, and the other end of the fourth sealing element is in sealing contact connection with the pressure relief port.

The pressure balancing device can be fixedly installed by riveting, screwing, welding, pin connection and the like, and the other end of the pressure balancing device is in sealing contact connection with the pressure relief port, the first sealing element and the fourth sealing element can be made of elastic materials, and can also be connected in a hinged mode and the like (such as plastic, metal or other materials in a hinged mode), or utilize an elastic force (such as a torsion spring, a spring, a tension spring, rubber and the like), magnetic force, gravity and the like, so that the pressure relief port can be opened or closed when no external force exists. Certainly, the pressure balancing device can also be used as an independent device and then arranged on the floater. The convex block is configured to form a pressure relief channel between the cover plate and the floater.

When the cover plate is not arranged, the floater floats in the liquid storage device. When the cover plate is arranged, the floater floats in the liquid storage device below the cover plate.

The working process of the self-adjustable gas isolator is as follows: assuming the liquid storage device is in a liquid with no buoyancy or below the buoyancy of the floater, or in the initial state after the liquid is discharged, the floater is at the lowest position and seal the liquid outlet for blocking the liquid outlet and the gas channel of the liquid storage device.

When the cover plate is not arranged, liquid flows into the liquid storage device directly, and liquid flows into the liquid storage device from the liquid discharging hole when the cover plate is arranged. Liquid flows into the liquid storage device to continuously raise the liquid level, when the liquid level rises to the buoyancy greater than the weight of the floater and the pressure balancing device, the floater rises accordingly, and then the floater leaves the liquid outlet and opens the liquid discharging channel to start discharging liquid. The height of the floater is related to the liquid flow rate and the liquid discharge speed, if the inflow speed of the liquid is high, the liquid discharging speed is low, and the liquid level continues to rise, the distance between the floater and the liquid outlet is larger, and the liquid discharging speed is higher. When the balance is achieved, the liquid level keeps unchanged, and otherwise, the liquid level decreases to the balance position. The liquid enters the closed discharging channel, so that the space in the channel becomes small to generate pressure, and the discharge liquid is under resistance, and the liquid discharging speed slows down. And if the liquid flowing into the liquid storage device is larger than the liquid discharged out of the liquid storage device, the liquid level rises.

First, the cover plate is not arranged on the liquid storage device, when the floater rises to a certain height, the floater is inclined to release the pressure. Without the pressure, the liquid discharge speed is accelerated, and the liquid level is reduced to reach balance accordingly.

Second, the cover plate is arranged on the liquid storage device, the convex block is arranged on the cover plate. When the height of the floater is lower than that of the convex block, the pressure borne by the pressure balancing device is equal to the weight of the floater and is smaller than the opening force of the pressure balancing device, the floater continues to rise along with the liquid. When the floater touches the convex block, the floater stops rising (if the convex block is arranged on the floater and not arranged on the cover plate, that is: when the convex block touches the cover plate, the floater stops rising), and the pressure borne by the pressure balancing device is equal to the weight of the liquid discharged by the floater and is larger than the opening force of the pressure balancing device, one end of the fourth sealing element which is in sealing contact connection with the pressure relief port generates deformation or displacement, the pressure is released from the pressure relief port. After the pressure is released, the pressure balance device is closed, the liquid discharge speed is accelerated, and the liquid level starts to descend to reach the balance position.

When the volume of the liquid discharge changes or finishes liquid discharge, the liquid level change enables the liquid discharging channel to generate negative pressure, the suction force of the negative pressure enables the floater to move towards the liquid outlet, and the negative pressure borne by the pressure balancing device is increased. When the negative pressure is larger than the opening force of the pressure balancing device, one end of the first sealing element which is in sealing contact connection with the pressure relief port generates deformation or displacement, and the pressure relief port is opened to release negative pressure. After the pressure is released, the pressure balancing device is closed, the floater cannot be sucked on the liquid outlet due to negative pressure to block the liquid discharging channel, and the floater returns to the balance state.

As the second preferred scheme of the present invention, the present preferred scheme is basically the same as the first preferred scheme except that: the pressure balancing device is composed of a second sealing element, a spring and an ejector rod; the spring is sleeved on the ejector rod, one end of the spring is arranged on the ejector rod, the other end of the spring is arranged on the floater, and the second sealing element is in sealing contact connection with the pressure relief port.

The working process is as follows: when positive pressure is generated, the ejector rod rises to the cover plate along with the liquid level, and the buoyancy force borne by the ejector rod and the pressure of the cover plate are larger than the elasticity of the spring, the spring is compressed by the ejector rod, and the second sealing element opens the pressure relief port to release pressure. When negative pressure is generated, and the suction force of the negative pressure is larger than the elasticity of the spring, the second sealing element opens the pressure relief port to release negative pressure.

As the third preferred scheme of the present invention, the preferred scheme is basically the same as the first preferred scheme except that: the pressure balancing device is composed of a third sealing element, a magnetic material, an ejector rod and a support; the support is fixedly arranged on the floater, the ejector rod is sleeved in the support for axial movement; the magnetic material is arranged on the floater and the third sealing element or the ejector rod, and the third sealing element is in sealing contact connection with the pressure relief port.

The working process is as follows: when positive pressure is generated, the ejector rod rises to the cover plate along with the liquid level, and the buoyancy force borne by the ejector rod and the pressure of the cover plate are larger than the magnetic force, the ejector rod enables the second sealing element to open the pressure relief opening to release pressure. When negative pressure is generated, and the suction force of the negative pressure is larger than the magnetic force, the second sealing element opens the pressure relief port to release negative pressure.

As the fourth preferred scheme of the present invention, the preferred scheme is basically the same as the first preferred scheme except that: the pressure balancing device comprises a fifth sealing element, a convex block is arranged on the floater or the cover plate; one end of the fifth sealing element is arranged on the floater, and the other end of the fifth sealing element is in sealing contact connection with the pressure relief port. One end of the fifth sealing element is fixedly mounted on the floater by means of adhesion, welding, and the like, and the other end of the fifth sealing element is in sealed contact with the pressure relief port.

As the fifth preferred scheme of the present invention, the preferable scheme is basically the same as the first preferred scheme to the fourth preferred scheme except that: the pressure balancing device is changed into a hinged connection structure. The pressure balancing device comprises the first sealing element, the elastic component; the first sealing element can be provided with the protrusion or not; one end of the elastic component is arranged at one end in sealing contact with the pressure relief port, and the other end is arranged on the floater or arranged at one end of the first sealing element fixed on the floater. One end of the first sealing element is hinged to the floater or is in hinged connection with one end of the first sealing element fixed on the floater, and the other end of the first sealing element is in sealing contact connection with the pressure relief port. Certainly, the pressure balancing device can also have other mature structural schemes, such as adopting gravity, buoyancy and other mode, a pull rod, a lever and other structures.

The beneficial effects are as follows:

The self-adjustable gas isolator of the present invention has the function of automatically balancing the pressure, automatically adjusting the opening degree of the liquid outlet according to the liquid flow. Components for blocking discharging liquid and hooking sundries are not arranged in the liquid discharging channel, high liquid discharging speed and difficult to block, and the floater can swing or rotate when the liquid flows through, achieving the self-cleaning function and isolating harmful gas with or without liquid. The device has the advantages of simple structure, convenient maintenance, cleaning and disassembly, easy production, low cost, wide application range, easy popularization and the like.

BRIEF DESCRIPTION OF THE DRAWINGS

The present invention is further described below with reference to the accompanying drawings and the embodiments.

Components of the self-adjustable gas isolator shown in FIG. 1, FIG. 2, FIG. 3, FIG. 4, FIG. 5, FIG. 6, FIG. 7, FIG. 8, FIG. 9, FIG. 10 and FIG. 11: 1 is the floater, 1*a* is the groove, 1*b* is the pressure relief port, 2 is the pressure balancing device, 2*a* is the first sealing element, 2*b* is the second sealing element, 2*c* is the spring, 2*d* is the third sealing element, 2*e* is the magnetic material, 2*f* is the ejector rod, 2*g* is the fourth sealing element, 2*h* is the support, 2*i* is the fifth sealing element, 2*j* is the elastic component, 2*k* is the protrusion, 3 is the liquid storage device, 3*a* is the liquid discharge opening, 4 is the cover plate, 4*a* is the liquid discharging hole, 4*b* is the convex block and a is a schematic of the liquid level line.

DETAILED DESCRIPTION OF THE PRESENT INVENTION

Embodiment 1

Figure 1:
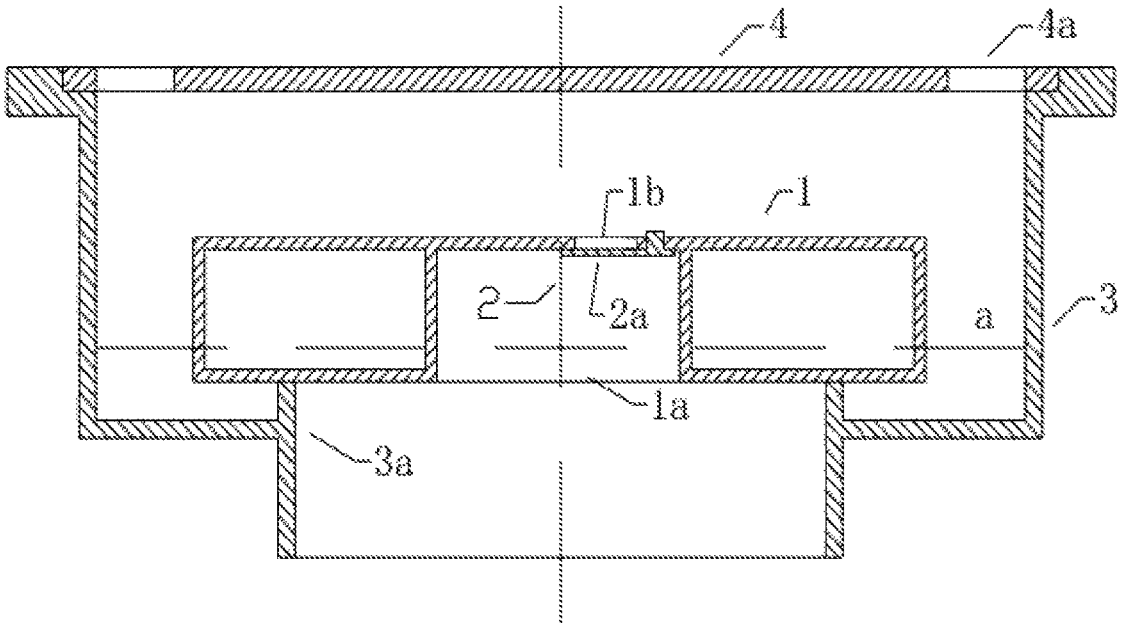
FIG. 1 is a schematic diagram of the low liquid level of the self-adjustable gas isolator in pressure balance according to the present invention.
Figure 2:
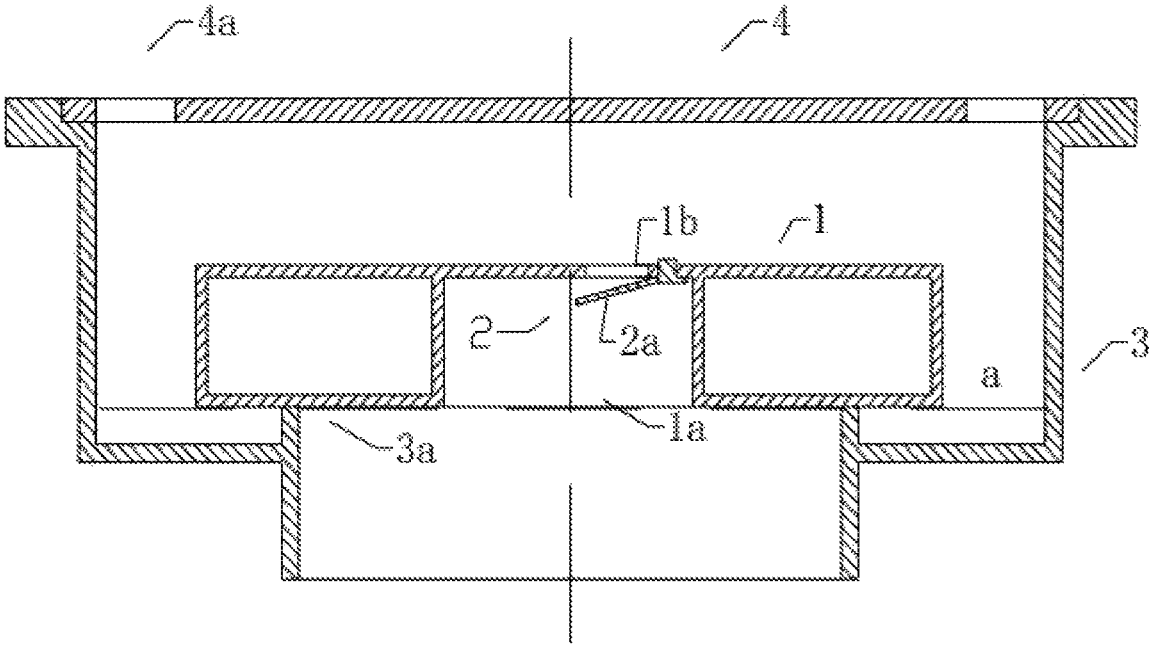
FIG. 2 is a schematic diagram of the pressure balancing device in opening state of the self-adjustable gas isolator with a negative pressure according to the present invention.
Figure 3:
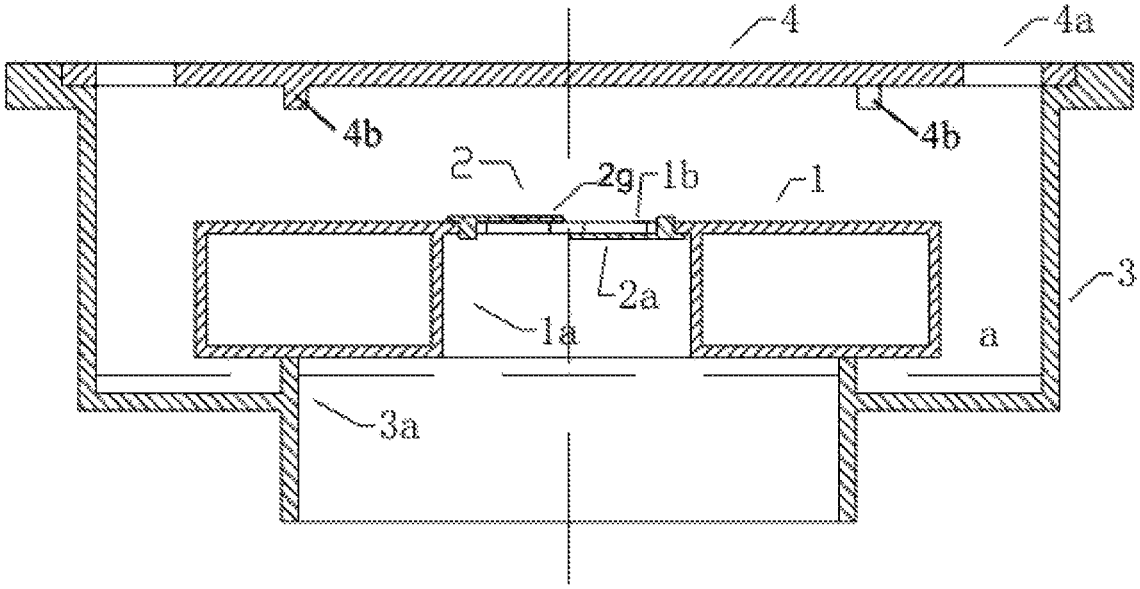
FIG. 3 is another schematic diagram of the low liquid level of the self-adjustable gas isolator in pressure balance according to the present invention.
Figure 4:
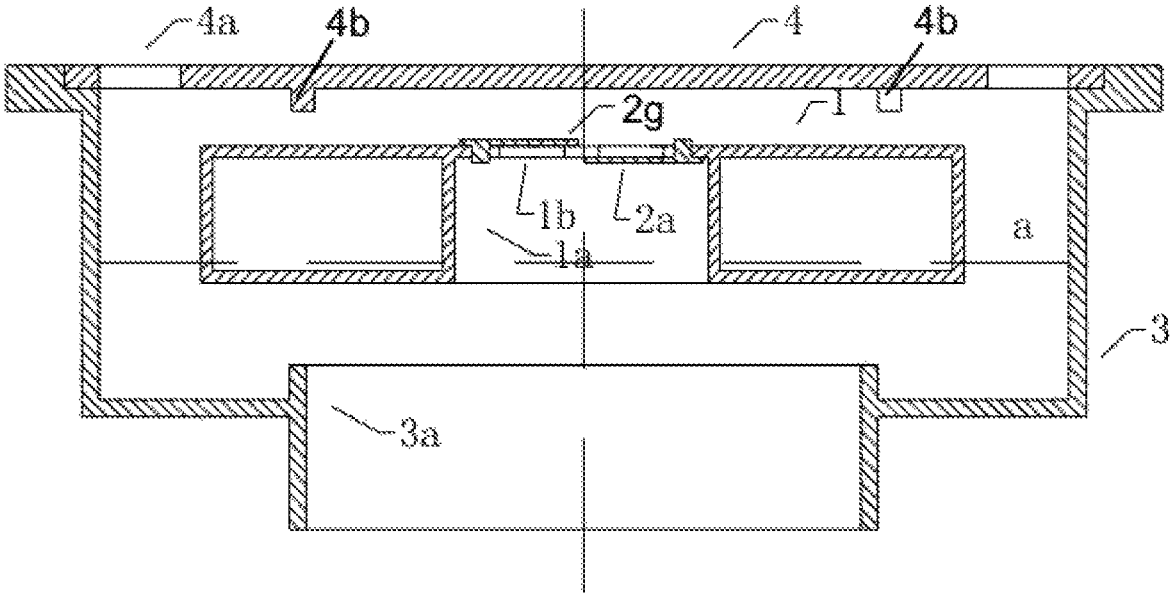
FIG. 4 is a schematic diagram of the self-adjustable gas isolator when discharging normally.
Figure 5:
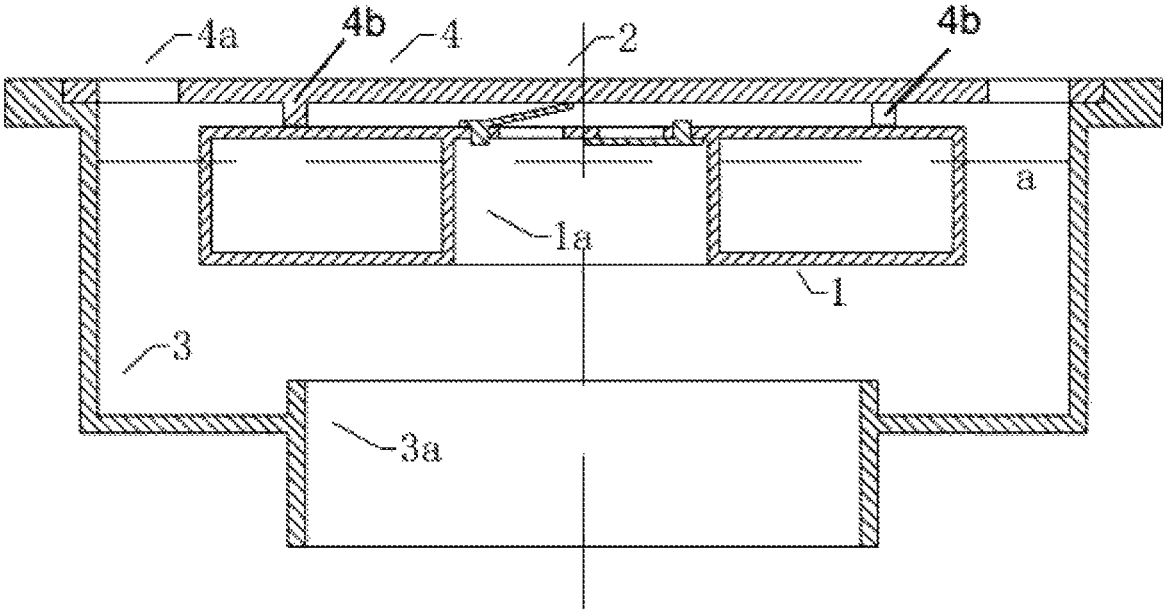
FIG. 5 is a schematic diagram of the high liquid level of the pressure balancing device in opening state of the self-adjustable gas isolator according to the present invention.
Figure 6:
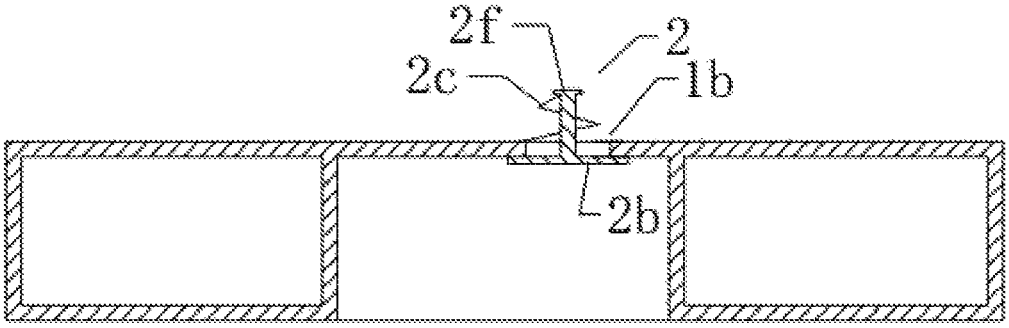
FIG. 6 is a schematic diagram of pressure balancing device with spring type of the self-adjustable gas isolator according to the present invention.
Figure 7:
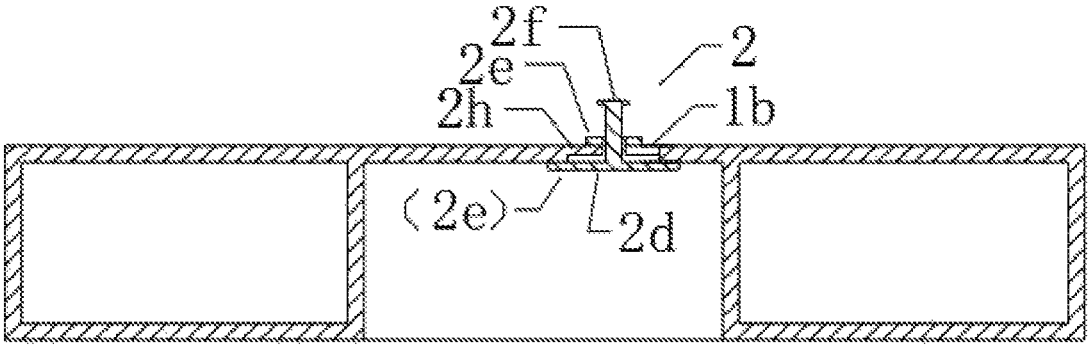
FIG. 7 is a schematic diagram of the pressure balancing device with magnetic type of the self-adjustable gas isolator according to the present invention.
Figure 8:
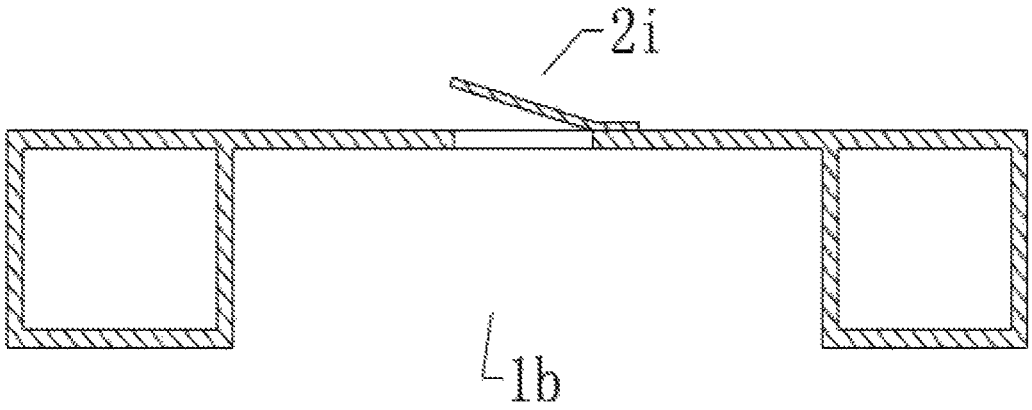
FIG. 8 is a schematic diagram of the pressure balancing device in opening state of the self-adjustable gas isolator with a positive pressure according to the present invention.
Figure 9:
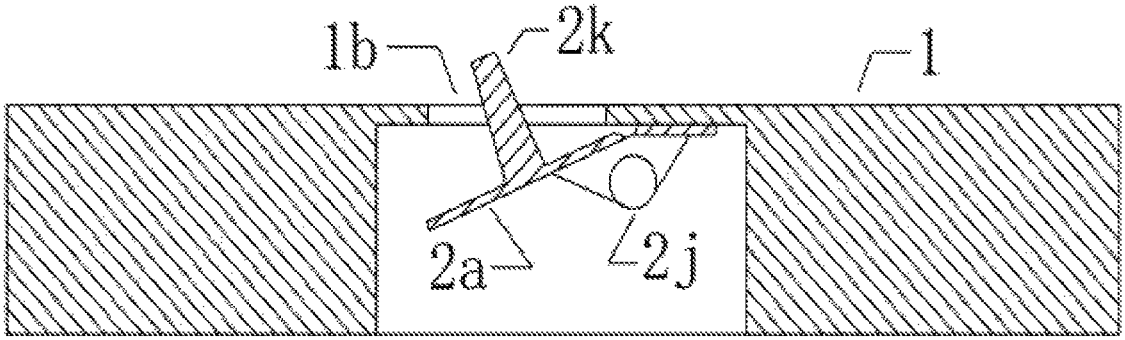
FIG. 9 is another structural schematic diagram of the floater and the pressure balancing device of the self-adjustable gas isolator according to the present invention.
Figure 10:
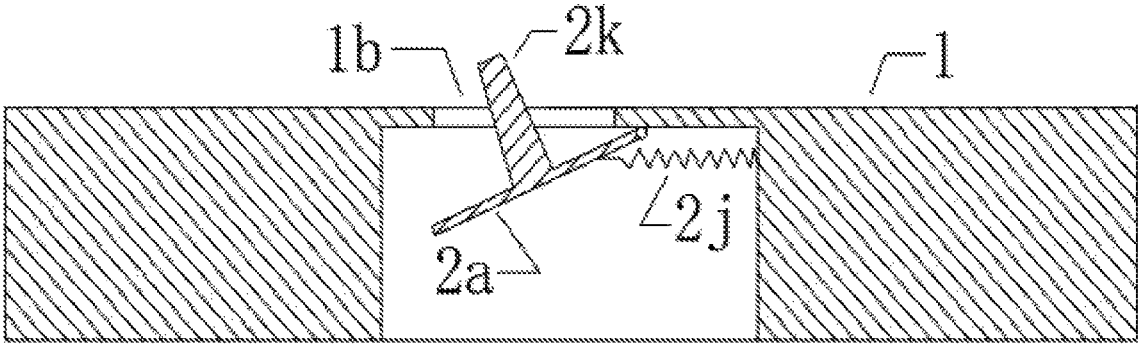
FIG. 10 is another structural schematic diagram of the floater and the pressure balancing device of the self-adjustable gas isolator according to the present invention.
Figure 11:
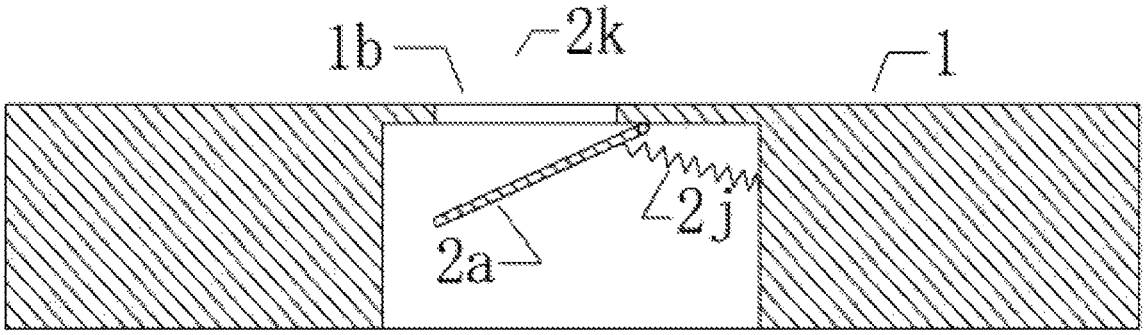
FIG. 11 is another structural schematic diagram of the floater and the pressure balancing device of the self-adjustable gas isolator according to the present invention.

As shown in FIG. 1 and FIG. 2, the self-adjustable gas isolator of the embodiment 1 includes a floater 1, a pressure balancing device 2 and a liquid storage device 3; the floater 1 is provided with a groove 1*a*, and a pressure relief port 1*b* is arranged on the groove 1*a*; the pressure balancing device 2 comprises a first sealing element 2*a*; the liquid storage device 3 is provided with a liquid discharge opening 3*a*, and a liquid discharge hole 4*a* is arranged on the cover plate 4; the floater 1 is arranged in the liquid storage device 3, and the floater 1 floats in the liquid storage device 3; one end of the first sealing element 2*a* is arranged on the floater 1, and the other end of the first sealing element 2*a* is in sealing contact connection with the pressure relief port 1*b*.

The working process of the self-adjustable gas isolator described by the embodiment 1 is as follows: assuming the liquid storage device 3 is in a liquid with no buoyancy or in the initial state after the liquid is discharged, the floater 1 is at the lowest position and seal the liquid outlet 3*a* for blocking the liquid outlet 3*a* and the gas channel of the liquid storage device 3.

If the liquid flows into the liquid storage device 3 to continuously raise the liquid level, and when the liquid level rises to the buoyancy greater than the weight of the floater 1 and the pressure balancing device 2, the floater 1 rises accordingly, and then the floater 1 leaves the liquid outlet 3*a* and opens the liquid discharging channel to start discharging liquid. The height of the floater 1 is related to the liquid flow rate and the liquid discharge speed, if the inflow speed of the liquid is high, the liquid discharging speed is low, and the liquid level continues to rise, the distance between the floater 1 and the liquid outlet 3*a* is larger, and the liquid discharging speed is higher. When the balance is achieved, the liquid level keeps unchanged, and otherwise, the liquid level decreases to the balance position.

After the liquid enters the closed discharging channel, the space in the channel becomes small to generate pressure, and the pressure is opposite to the flowing direction of the liquid, so the discharge liquid is under resistance, and the liquid discharging speed slows down. The liquid flowing into the liquid storage device is larger than the liquid discharged out of the liquid storage device, the liquid level rises. When the floater 1 rises to a certain height, the floater 1 inclines to release pressure. Without the pressure, the liquid discharge speed is accelerated, and the liquid level is reduced to reach balance accordingly.

When the volume of liquid flowing into is changed or the liquid level is reduced, a negative pressure is generated by the liquid discharging channel, the suction force of the negative pressure enables the floater 1 to move downwards, and the liquid discharged by the floater 1 is increased, and the suction force on the pressure balancing device 2 is increased; when the suction force is larger than the opening force of the pressure balancing device 2, and one end of the first sealing element 2*a* which is in sealing contact connection with the pressure relief port 1*b* generates deformation or displacement, the pressure relief port 1*b* is opened to release the pressure. After the pressure is released, the pressure balancing device 2 is closed, the floater 1 cannot be sucked on the liquid outlet 3*a* due to negative pressure to block the liquid discharging channel, and the isolator continues to work normally. After the liquid discharge is completed, the floater 1 falls back to the lowest position of the initial state, and the gas channel of the liquid discharging port 3*a* is closed.

Embodiment 2

As shown in FIG. 3, FIG. 4, FIG. 5 and FIG. 8 is the self-adjustable gas isolator of the embodiment 2, the basic structure of the present embodiment is the same as the embodiment 1, and the differences are as follows: the self-adjustable gas isolator further comprises a cover plate 4, the pressure balance device 2 comprises a fifth sealing element 2*i*, and the first sealing element 2*a* is omitted; a liquid discharging hole 4*a* is arranged on the cover plate 4, a convex block 4*b* is arranged on the cover plate 4 or the floater 1; one end of the fifth sealing element 2*i* is fixedly arranged on the floater 1, and the other end of the fifth sealing element 2*i* is in sealing contact connection with the pressure relief port 1*b*.

Liquid flows into the liquid storage device 3 through the liquid discharge hole 4*a* to enable the floater 1 to rise to be balanced, and the pressure borne by the pressure balancing device 2 is equal to the weight of the floater 1 and is smaller than the opening force of the pressure balancing device 2. If the positive pressure is generated, the floater 1 continues to rise along with the liquid, when being in contact with the convex block 4*b*, the floater 1 stops rising (assuming that the convex block 4*b* is arranged on the floater 1, it should be the convex block 4*b* being in contact with the cover plate 4), the pressure borne by the pressure balancing device 2 is equal to the liquid weight of the liquid volume discharged by the floater 1, and is larger than the opening force of the fourth sealing element 2*g*, one end of the fourth sealing element 2*g* which is in sealing contact connection with the pressure relief port 1*b* generates deformation or displacement, and the other end of the sealing element is connected with the pressure relief opening 1*b* in a sealing mode, the pressure relief opening 1*b* is opened or deformed to release the pressure, and the pressure balancing device 2 is closed after release, the liquid discharge speed is accelerated, and the liquid level is reduced until reaching a balance state. The case of negative pressure is the same as in embodiment 1.

Embodiment 4

As shown in FIG. 1, FIG. 3, FIG. 4, FIG. 5 and FIG. 6 is the self-adjustable gas isolator of the embodiment 4, the basic structure of the present embodiment is the same as that of the embodiment 1, the embodiment 2 and the embodiment 3, and the differences are as follows: the pressure balancing device 2 is changed into a spring type structure, comprising a second sealing element 2*b*, a spring 2*c* and an ejector rod 2*f*; two ends of the spring 2*c* are respectively arranged on the ejector rod 2*f* and the floater 1, the second sealing element is in sealing contact connection with the pressure relief port 1*b*.

When the floater 1 generates a negative pressure which is larger than the elastic force of the spring 2*c*, and the suction force of the negative pressure enables the spring 2*c* to deform, the second sealing element 2*b* opens the pressure relief port 1*b* which is in sealing contact connection. When the positive pressure liquid level rises and the top rod 2*f* is lifted to the cover plate 4 along with the liquid level and the floater 1, the ejection rod 2*f* is under the action force of the buoyancy force and the cover plate 4, the spring 2*c* is compressed, and the second sealing element 2*b* opens the pressure relief port 1*b* to release pressure.

Embodiment 5

As shown in FIG. 1, FIG. 3, FIG. 4, FIG. 5 and FIG. 7 is the self-adjustable gas isolator of the embodiment 5, the basic structure of the present embodiment is the same as the embodiment 1, the embodiment 1, the embodiment 2, the embodiment 3 and the embodiment 4, and the differences are as follows: the pressure balancing device 2 is changed into a magnetic structure, comprises a third sealing element 2*d* and a magnetic material 2*e*, an ejector rod 2*f* and a support 2*h*; the magnetic material 2*e* is made of a pair of attracted or repulsive materials, such as a magnet and an iron metal, or a pair of the magnet and matched materials, so that mutual attraction or repelling effects can be generated in a certain distance; the support 2*h* is arranged on the floater 1, and the ejector rod 2*f* is sleeved in the support 2*h* for axial movement; the magnetic material 2*e* are respectively arranged on the floater 1 and the third sealing element 2*d*, or arranged on the floater 1 and the ejector rod 2*f*.

When the negative pressure generated on the floater 1 is larger than the interaction force of the magnetic material 2*e*, the suction force of the negative pressure overcomes the magnetic force to enable the third sealing element 2*d* to open the pressure relief port 1*b* to release the pressure. When the positive pressure is larger than the magnetic force, the ejector rod 2*f* pushes the third sealing element 2*d* to open the pressure relief port 1*b* to release the pressure.

Embodiment 6

As shown in FIG. 1, FIG. 6, FIG. 7, FIG. 9, FIG. 10 and FIG. 11 is the self-adjustable gas isolator of the embodiment 6, the basic structure of the embodiment is the same as the embodiment 1, the embodiment 2, the embodiment 3, the embodiment 4 and the embodiment 5, and the differences are as follows: the pressure balancing device 2 is changed into a hinged connection structure, including a first sealing element 2*a* and an elastic member 2*j*; the first sealing element 2*a* is provided with a protrusion 2*k* (or no protrusion 2*k*, as shown in embodiment 1); one end of the elastic component 2*j* is arranged on the movable member in sealing contact connection with the first sealing element 2*a* and the pressure relief port 1*b*, and the other end of the elastic component 2*j* is arranged on the floater 1, or the fixing member connected with the first sealing element 2*a*; one end of the first sealing element 2*a* is hinged to the floater 1, or is in hinged connection with a fastener fixed on the floater 1, and the other end of the first sealing element 2*a* is in sealing contact connection with the pressure relief port 1*b*.

When the negative pressure generated on the floater 1 is larger than the elasticity of the elastic member 2*j*, and the suction force of the negative pressure enables the elastic member 2 to be deformed, the end of the first sealing element 2*a* in sealing contact connection with the pressure relief port 1*b* is displaced, and the pressure relief port 1*b* is opened to relieve pressure. the liquid level rises when positive pressure is generated, the protrusion 2*k*, the first sealing element 2*a* and the floater 1 all rise along with the liquid level, and when the protrusion 2*k* is contact with the cover plate 4, the elastic member 2*j* is deformed by the action force of the protrusion 2*k* under the buoyancy and the cover plate 4, the first sealing element 2*a* opens the pressure relief port 1*b* to release the pressure.

Above disclosure are merely a part of typical examples of the self-adjustable gas isolator of the present invention, and the drawings are only a part of the schematic diagram. Regardless of the structure, shape and material of the pressure balancing device 2, any device including the floater 1, the pressure relief port 1*b*, the pressure balancing device 2 and the liquid storage device 3 falls within the protection scope of the present invention.

What is claimed is:

1. A self-adjustable gas isolator, comprising a floater (1), a liquid storage device (3) and a liquid outlet (3*a*); wherein the self-adjustable type gas isolator further comprises a pressure balancing device (2); a pressure relief port (1*b*) is provided on the floater (1), the pressure balancing device (2) is connected with the floater (1) in fixed position, and the pressure balancing device (2) is arranged on a surface of the floater (1) away from the liquid outlet (3*a*).

2. The self-adjustable gas isolator according to claim 1, wherein the pressure balancing device (2) comprises a first sealing element (2*a*); one end of the first sealing element (2*a*) is fixedly arranged on the floater (1), and the other end of the first sealing element (2*a*) is in sealing contact connection with the pressure relief port (1*b*).

3. The self-adjustable gas isolator according to claim 1, wherein the self-adjustable gas isolator further comprises a cover plate (4); the pressure balancing device comprises a sealing element (2*i*); a liquid discharging hole (4*a*) is provided on the cover plate (4), and the cover plate (4) or the floater (1) is provided with a convex block (4*b*); one end of the sealing element (2*i*) is fixedly arranged on the floater (1), and the other end of the fifth sealing element (2*i*) is in sealing contact connection with the pressure relief port (1*b*).

4. The self-adjustable gas isolator according to claim 1, wherein the self-adjustable gas isolator further comprises a cover plate (4); the pressure balancing device (2) comprises a first sealing element (2*a*) and a second sealing element (2*g*), the cover plate (4) is provided with a liquid discharging hole (4*a*), and the cover plate (4) or the floater (1) is provided with a convex block (4*b*); one end of the first sealing element (2*a*) is arranged on the floater (1), and the other end of the first sealing element (2*a*) is in sealing contact connection with the pressure relief port (1*b*); one end of the second sealing element (2*g*) is arranged on the floater (1), and the other end of the fourth second sealing element (2*g*) is in sealing contact connection with the pressure relief port (1*b*).

5. The self-adjustable gas isolator according to claim 1, wherein the self-adjustable gas isolator further comprises a cover plate (4); the pressure balancing device comprises a first sealing element (2*a*) and an elastic component (2*j*); a protrusion (2*k*) is arranged on the first sealing element (2*a*), and a liquid discharging hole (4*a*) is formed in the cover plate (4*a*); one end of the elastic component (2*j*) is arranged on a movable member in sealing contact connection with the first sealing element (2*a*) and the pressure relief port (1*b*), and the other end of the elastic component (2*j*) is arranged on the floater (1); one end of the first sealing element (2*a*) is movably connected with the floater (1), and the other end of the first sealing element (2*a*) is in sealing contact connection with the pressure relief port (1*b*).

6. The self-adjustable gas isolator according to claim 1, wherein the self-adjustable gas isolator further comprises a cover plate (4); the pressure balancing device comprises a first sealing element (2*a*) and an elastic component (2*j*); a protrusion (2*k*) is arranged on the first sealing element (2*a*), and a liquid discharging hole (4*a*) is arranged on the cover plate (4*a*); one end of the elastic component (2*j*) is arranged on a movable member in sealing contact connection with the (2*a*) and the pressure relief port (1*b*), and the other end of the elastic component (2*j*) is arranged on a fastener connected with the first sealing member (2*a*) and the floater (1); one end of the first sealing element (2*a*) is movably connected with the floater (1), and the other end of the first sealing element (2*a*) is in sealing contact connection with the pressure relief port (1*b*).

7. The self-adjustable gas isolator according to claim 1, wherein the self-adjustable gas isolator further comprises a cover plate (4); the pressure balancing device (2) comprises a sealing element (2*b*), a spring (2*c*) and an ejector rod (2*f*); the spring (2*c*) is sleeved on the ejector rod (2*f*), one end of the spring (2*c*) is arranged on the ejector rod (2*f*), and the other end of the spring (2*c*) is arranged on the floater (1); and the sealing element (2*b*) is in sealing contact connection with the pressure relief port (1*b*).

8. The self-adjustable gas isolator according to claim 1, wherein the self-adjustable gas isolator further comprises a cover plate (4); the pressure balancing device (2) consists of a sealing element (2*d*), a magnetic material (2*e*), an ejector rod (2*f*) and a support (2*h*); a liquid discharging hole (4*a*) is arranged on the cover plate (4*a*); the support (2*h*) is fixedly arranged on the floater (1); the ejector rod (2*f*) is sleeved in the support (2*h*) for axial movement; the magnetic material (2*e*) is arranged on the floater (1) and the sealing element (2*d*), and the sealing element (2*d*) is in sealing contact connection with the pressure relief port (1*b*).

9. The self-adjustable gas isolator according to claim 1, wherein the self-adjustable gas isolator further comprises a cover plate (4); the pressure balancing device (2) consists of a sealing element (2*d*), a magnetic material (2*e*), an ejector rod (2*f*) and a support (2*h*); a liquid discharging hole (4*a*) is arranged on the cover plate (4*a*); a support (2*h*) is fixedly arranged on the floater (1); the ejector rod (2*f*) is sleeved in the support (2*h*) for axial movement; the magnetic material (2*e*) is arranged on the floater (1) and the ejector rod (2*f*); and the sealing element (2*d*) is in sealing contact connection with the pressure relief port (1*b*).

10. The self-adjustable gas isolator according to claim 3, wherein the cover plate (4) is arranged on the liquid storage device (3), and the floater (1) floats in the liquid storage device (3) under action of liquid level.

11. The self-adjustable gas isolator according to claim 4, wherein the cover plate (4) is arranged on the liquid storage device (3), and the floater (1) floats in the liquid storage device (3) under action of liquid level.

12. The self-adjustable gas isolator according to claim 5, wherein the cover plate (4) is arranged on the liquid storage device (3), and the floater (1) floats in the liquid storage device (3) under action of liquid level.

13. The self-adjustable gas isolator according to claim 6, wherein the cover plate (4) is arranged on the liquid storage device (3), and the floater (1) floats in the liquid storage device (3) under action of liquid level.

14. The self-adjustable gas isolator according to claim 7, wherein the cover plate (4) is arranged on the liquid storage device (3), and the floater (1) floats in the liquid storage device (3) under action of liquid level.

15. The self-adjustable gas isolator according to claim 8, wherein the cover plate (4) is arranged on the liquid storage device (3), and the floater (1) floats in the liquid storage device (3) under action of liquid level.

16. The self-adjustable gas isolator according to claim 9, wherein the cover plate (4) is arranged on the liquid storage device (3), and the floater (1) floats in the liquid storage device (3) under action of liquid level.

* * * * *